US009505587B2

(12) United States Patent
Okada et al.

(10) Patent No.: US 9,505,587 B2
(45) Date of Patent: Nov. 29, 2016

(54) ELEVATOR WITH ACCELERATION DETECTION

(75) Inventors: Mineo Okada, Tokyo (JP); Kenichi Okamoto, Tokyo (JP); Yoshikatsu Hayashi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 13/882,369

(22) PCT Filed: Nov. 1, 2010

(86) PCT No.: PCT/JP2010/069437

§ 371 (c)(1),
(2), (4) Date: Apr. 29, 2013

(87) PCT Pub. No.: WO2012/059970

PCT Pub. Date: May 10, 2012

(65) Prior Publication Data

US 2013/0220739 A1 Aug. 29, 2013

(51) Int. Cl.

| | |
|---|---|
| ***B66B 5/04*** | (2006.01) |
| ***B66B 5/22*** | (2006.01) |
| ***B66B 5/28*** | (2006.01) |
| ***B66B 5/16*** | (2006.01) |

(52) U.S. Cl.

CPC ..... *B66B 5/04* (2013.01); *B66B 5/044* (2013.01); *B66B 5/16* (2013.01); *B66B 5/22* (2013.01); *B66B 5/28* (2013.01)

(58) Field of Classification Search

CPC ..... B66B 5/044; B66B 5/046; B66B 5/12; B66B 5/18; B66B 5/22; B61H 7/12; B61H 11/14

USPC ..... 187/343–344, 373–376

See application file for complete search history.

(56) References Cited

U.S. PATENT DOCUMENTS

| | | | | |
|---|---|---|---|---|
| 1,957,311 | A * | 5/1934 | Baumgartner | B66B 5/044 187/305 |
| 2,001,361 | A * | 5/1935 | Hymans | B66B 5/044 187/376 |
| 2,581,297 | A * | 1/1952 | Rissler | 187/375 |
| 3,762,512 | A * | 10/1973 | McIntyre | 188/189 |
| 4,083,432 | A | 4/1978 | Lusti | |
| 5,224,570 | A * | 7/1993 | Fromberg | 187/376 |
| 5,513,724 | A * | 5/1996 | De Jong | 187/264 |
| 5,628,385 | A * | 5/1997 | Yumura | B66B 5/044 187/373 |

(Continued)

FOREIGN PATENT DOCUMENTS

| | | |
|---|---|---|
| EP | 1 604 935 A1 | 12/2005 |
| GB | 1021552 | 3/1966 |

(Continued)

OTHER PUBLICATIONS

U.S. Appl. No. 13/996,873, filed Jun. 21, 2013, Okamoto, et al.

(Continued)

*Primary Examiner* — William A Rivera
*Assistant Examiner* — Stefan Kruer
(74) *Attorney, Agent, or Firm* — Oblon, McClelland, Maier & Neustadt, L.L.P.

(57) ABSTRACT

In an elevator apparatus, a car is suspended by a suspending means. The car is raised and lowered by a driving apparatus by means of the suspending means. The car is braked by a braking apparatus. An abnormal acceleration detecting mechanism operates the braking apparatus to stop the car if acceleration that exceeds a preset set value arises in the car.

6 Claims, 15 Drawing Sheets

(56) References Cited

U.S. PATENT DOCUMENTS

| | | | | | |
|---|---|---|---|---|---|
| 5,937,973 | A * | 8/1999 | Liebetrau | B66B 5/22 | 187/373 |
| 6,003,636 | A * | 12/1999 | Yumura | B66B 5/22 | 187/376 |
| 6,173,813 | B1 | 1/2001 | Rebillard et al. | | |
| 6,619,435 | B1 * | 9/2003 | Watzke | B66B 5/04 | 187/350 |
| 7,614,481 | B2 * | 11/2009 | Okamoto et al. | | 187/305 |
| 2003/0183457 | A1 * | 10/2003 | Maury | B66B 5/046 | 187/250 |
| 2004/0178023 | A1 * | 9/2004 | Maury | | 187/373 |
| 2007/0000734 | A1 * | 1/2007 | Hanninen et al. | | 187/373 |
| 2008/0185231 | A1 * | 8/2008 | Osterman et al. | | 187/247 |
| 2009/0101450 | A1 * | 4/2009 | Kugiya et al. | | 187/305 |
| 2012/0103732 | A1 * | 5/2012 | Kwon | B66B 5/044 | 187/305 |
| 2013/0264149 | A1 * | 10/2013 | Okamoto | B66B 5/06 | 187/247 |

FOREIGN PATENT DOCUMENTS

| | | | | |
|---|---|---|---|---|
| GB | 1359384 A * | 7/1974 | | B66B 5/18 |
| JP | 53 71445 | 6/1978 | | |
| JP | 5 155555 | 6/1993 | | |
| JP | 2002 533281 | 10/2002 | | |
| JP | 2003 104646 | 4/2003 | | |
| JP | 2004345803 A * | 12/2004 | | B66B 5/22 |
| JP | WO 2006033144 A1 * | 3/2006 | | B66B 5/22 |
| JP | WO 2006064555 A1 * | 6/2006 | | B66B 5/04 |
| JP | WO 2013157069 A1 * | 10/2013 | | B66B 5/0031 |
| JP | WO 2013190869 A1 * | 12/2013 | | B66B 5/18 |
| JP | WO 2015128931 A1 * | 9/2015 | | B66B 5/04 |
| WO | WO 00/39016 A1 | 7/2000 | | |
| WO | 2009 093330 | 7/2009 | | |
| WO | 2010/107407 A1 | 9/2010 | | |
| WO | WO 2010/107409 A1 | 9/2010 | | |
| WO | 2011 027432 | 3/2011 | | |

OTHER PUBLICATIONS

International Search Report Issued Feb. 8, 2011 in PCT/JP10/69437 Filed Nov. 1, 2010.

Office Action issued in Korean Patent Application No. 10-2013-7013905 on Jun. 9, 2014.

Extended European Search Report issued Oct. 27, 2014 in Patent Application No. 10859227.0.

* cited by examiner

ELEVATOR WITH ACCELERATION DETECTION

TECHNICAL FIELD

The present invention relates to an elevator apparatus in which a car is made to perform an emergency stop when there is an abnormality such as breakage of a suspending means or failure of a controlling apparatus, for example.

BACKGROUND ART

In conventional elevator apparatus speed governors, a first overspeed Vos (an activating speed of an operation stopping switch) is set to approximately 1.3 times a rated speed Vo, and a second overspeed Vtr (a safety activating speed) is set to approximately 1.4 times the rated speed Vo. If it is detected that the car has exceeded the rated speed and reached the first overspeed Vos due to an abnormality in the controlling apparatus, for example, power supply to a hoisting machine is interrupted to stop the car urgently. If the car is falling due to breakage of the main rope, etc., the second overspeed Vtr is detected by the speed governor, and a safety device is activated to make the car perform an emergency stop.

However, if the car is positioned in a vicinity of an end terminal floor of a hoistway, the car may reach a bottom portion of the hoistway before the car speed increases to the first overspeed Vos and the second overspeed Vtr, and in that case the car is decelerated and stopped by a buffer. For this purpose, the buffer requires a longer buffering stroke as the speed that must be decelerated increases, and the length of the buffer is determined by the first overspeed Vos and the second overspeed Vtr.

In answer to that, a method has also been proposed in which a car position switch is disposed in a vicinity of the end terminal floor to detect an abnormality at a terminal overspeed Vts that is lower than the first overspeed Vos when the car position switch is operated, and shut off the power supply to the hoisting machine.

Thus, provided that the main rope is still connected to the car, the car speed will not exceed the terminal overspeed Vts. If, on the other hand, the main rope breaks when the car is positioned in a vicinity of a lower end terminal floor of the hoistway, it is not possible to brake the car using the hoisting machine even if the terminal overspeed Vts is detected.

In that case, if Ts is the time from when the main rope breaks until the car collides with the buffer, then the impact speed Vs is:

$$Vs=Vts+g\times Ts.$$

If this impact speed Vs is lower than the second overspeed Vtr of the speed governor, then it is possible to shorten the buffering stroke of the buffer proportionately.

However, in recent years, there is demand for additional space saving and cost saving, and there has been demand for buffer dimensions to be shortened further, and speed governors have been proposed in which the first overspeed Vos and the second overspeed Vtr are reduced in the vicinity of end terminal floors (see Patent Literature 1 and 2, for example).

CITATION LIST

Patent Literature

[Patent Literature 1]
Japanese Patent Laid-Open No. 2003-104646 (Gazette)

[Patent Literature 2]
WO 2009/093330

SUMMARY OF THE INVENTION

Problem to be Solved by the Invention

In conventional elevator apparatuses such as those described above, the construction of the speed governors becomes complicated in order to lower the first overspeed Vos and the second overspeed Vtr in the vicinity of the end terminal floors.

The present invention aims to solve the above problems and an object of the present invention is to provide an elevator apparatus that enables space saving in a hoistway by a simple configuration.

Means for Solving the Problem

In order to achieve the above object, according to one aspect of the present invention, there is provided an elevator apparatus including: a car; a suspending means that suspends the car; a driving apparatus that raises and lowers the car by means of the suspending means; a braking apparatus that brakes the car; and an abnormal acceleration detecting mechanism that operates the braking apparatus to stop the car if acceleration that exceeds a preset set value arises in the car.

Effects of the Invention

In an elevator apparatus according to the present invention, because the braking apparatus is operated by the abnormal acceleration detecting mechanism if acceleration that exceeds a preset set value arises in the car, space saving can be achieved in a hoistway by a simple configuration without complicating construction of a speed governor.

DESCRIPTION OF EMBODIMENTS

Preferred embodiments of the present invention will now be explained with reference to the drawings.

Embodiment 1

Figure 1:
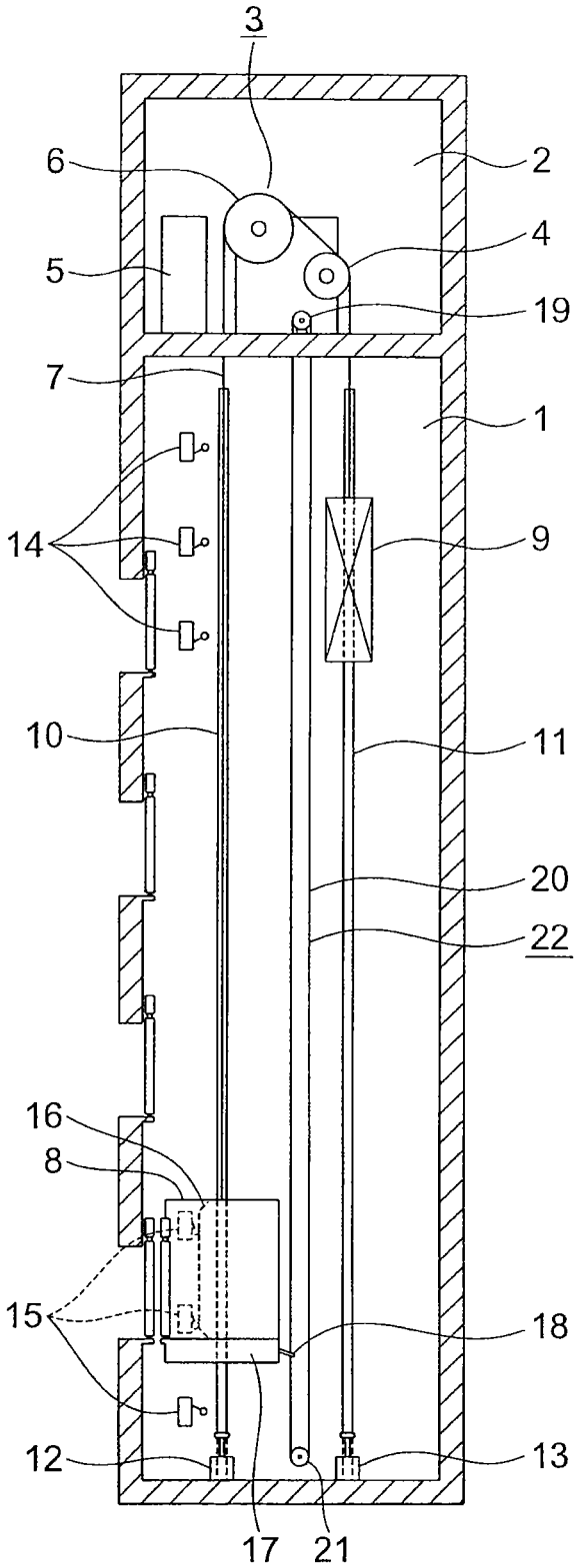
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 2 is disposed in an upper portion of a hoistway 1. A hoisting machine (a driving apparatus) 3, a deflecting sheave 4, and a controlling apparatus 5 are installed in the machine room 2. The hoisting machine 3 has: a driving sheave 6; a hoisting machine motor that rotates the driving sheave 6; and a hoisting machine brake (an electromagnetic brake) that brakes rotation of the driving sheave 6.

The hoisting machine brake has: a brake wheel (a drum or a disk) that is coupled coaxially to the driving sheave 6; a brake shoe that is placed in contact with and separated from the brake wheel; a brake spring that presses the brake shoe against the brake wheel to apply a braking force; and an electromagnet that separates the brake shoe from the brake wheel in opposition to the brake spring to release the braking force.

A suspending means 7 is wound around the driving sheave 6 and the deflecting sheave 4. A plurality of ropes or a plurality of belts are used as the suspending means 7. A car 8 is connected to a first end portion of the suspending means 7. A counterweight 9 is connected to a second end portion of the suspending means 7.

The car 8 and the counterweight 9 are suspended inside the hoistway 1 by the suspending means 7, and are raised and lowered inside the hoistway 1 by the hoisting machine 3. The controlling apparatus 5 raises and lowers the car 8 at a set speed by controlling rotation of the hoisting machine 3.

A pair of car guide rails 10 that guide raising and lowering of the car 8 and a pair of counterweight guide rails 11 that raising and lowering of the counterweight 9 are installed inside the hoistway 1. A car buffer 12 that buffers collision of the car 8 into a hoistway bottom portion, and a counterweight buffer 13 that buffers collision of the counterweight 9 into the hoistway bottom portion are installed on the bottom portion of the hoistway 1.

A plurality of (in this case, three) upper car position switches 14 are disposed so as to be spaced apart from each other vertically in a vicinity of an upper end terminal floor of the hoistway 1. A plurality of (in this case, three) lower car position switches 15 are disposed so as to be spaced apart from each other vertically in a vicinity of a lower end terminal floor of the hoistway 1.

A cam (an operating member) 16 that operates the car position switches 14 and 15 is mounted onto the car 8. The upper car position switches 14 are operated by the cam 16 when the car 8 reaches the vicinity of the upper end terminal floor. The lower car position switches 15 are operated by the cam 16 when the car 8 reaches the vicinity of the lower end terminal floor.

Figure 17A:
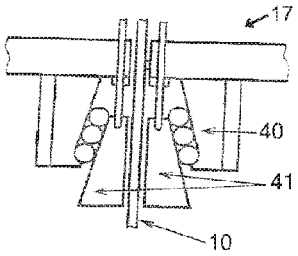
FIGS. 17A and 17B show a gradual safety in a normal state and an actuated state, respectively.
Figure 17B:
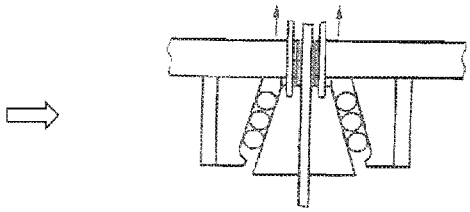
Figure 18:
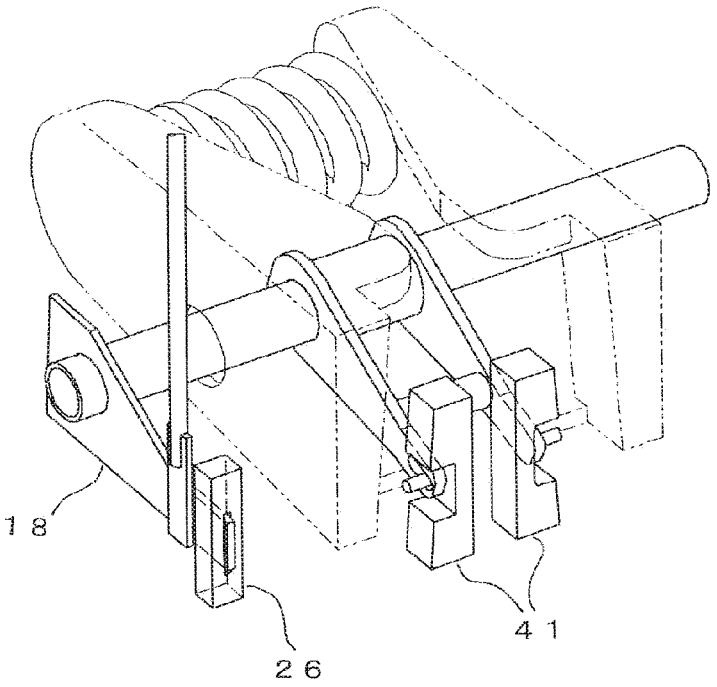
FIG. 18 shows a gradual safety with an actuating lever.

A safety device 17 that functions as a braking apparatus that makes the car 8 perform an emergency stop by engaging with the car guide rail 10 is mounted onto a lower portion of the car 8. A gradual safety, as shown in FIGS. 17A and 17B in a normal state and an actuated state respectively, is used as the safety device 17 (gradual safeties are generally used in elevator apparatuses in which rated speed exceeds 45 m/min). An actuating lever 18 that activates the safety device 17 is disposed on the safety device 17. When the actuating lever 18 is operated, the wedges 41 are displaced upwards with respect to the car along the slide/guide surfaces of the fixed portions 40 by being mechanically transmitted the rotational movement of the actuating lever. As a result, the wedges 41 are wedged in between the slide/guide surfaces and the car guide rail 10, so the car guide rail 10 is pinched between the wedges 41 to thereby bring the car to an emergency stop.

A speed governor 19 that detects an overspeed (an abnormal speed) of the car 8 is installed in the machine room 2. The speed governor 19 has a speed governor sheave, an overspeed detecting switch, a rope catch, etc. An endless speed governor rope 20 is wound around the speed governor sheave. The speed governor rope 20 is set up in a loop inside the hoistway 1. The speed governor rope 20 is wound around a tensioning sheave 21 that is disposed in a lower portion of the hoistway 1.

The speed governor rope 20 is connected to the actuating lever 18. Thus, the speed governor rope 20 is cycled when the car 8 is raised and lowered to rotate the speed governor sheave at a rotational speed that corresponds to the running speed of the car 8. A mass 22 according to Embodiment 1 is constituted by the speed governor 19, the speed governor rope 20, and the tensioning sheave 21.

The running speed of the car 8 reaching the overspeed is detected mechanically by the speed governor 19. A first overspeed Vos that is higher than a rated speed Vo and a second overspeed Vtr that is higher than the first overspeed are set as detected overspeeds.

The overspeed detecting switch is operated if the running speed of the car 3 reaches the first overspeed Vos. When the overspeed detecting switch is operated, power supply to the hoisting machine 3 is interrupted to stop the car 8 urgently using the hoisting machine brake.

If the descent speed of the car 8 reaches the second overspeed Vtr, the speed governor rope 20 is gripped by the rope catch to stop the cycling of the speed governor rope 20. When the cycling of the speed governor rope 20 is stopped, the actuating lever 18 is operated, and the car 8 is made to perform an emergency stop by the safety device 17.

Figure 2:
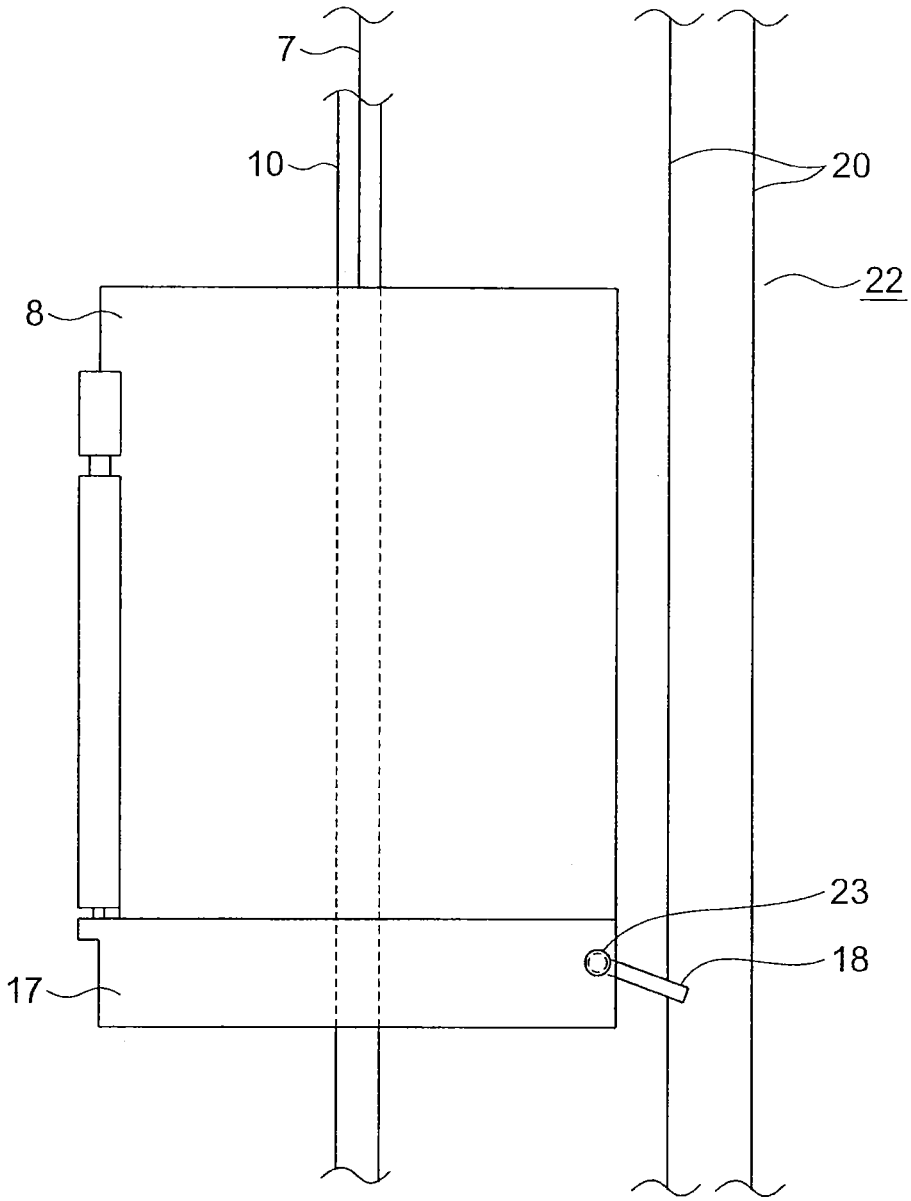
FIG. 2 is a configuration diagram that shows a car from FIG. 1 enlarged.

FIG. 2 is a configuration diagram that shows the car 8 from FIG. 1 enlarged. A torsion spring 23 that applies torque to the actuating lever 18 in a direction (counterclockwise in the figure) that is opposite to the direction that operates the safety device 17 is disposed on the pivoting shaft of the actuating lever 18. The spring force of the torsion spring 23 is set such that the safety device 17 is not activated in a normal hoisting state. An abnormal acceleration detecting mechanism according to Embodiment 1 includes the mass 22 and the torsion spring 23.

Figure 3:
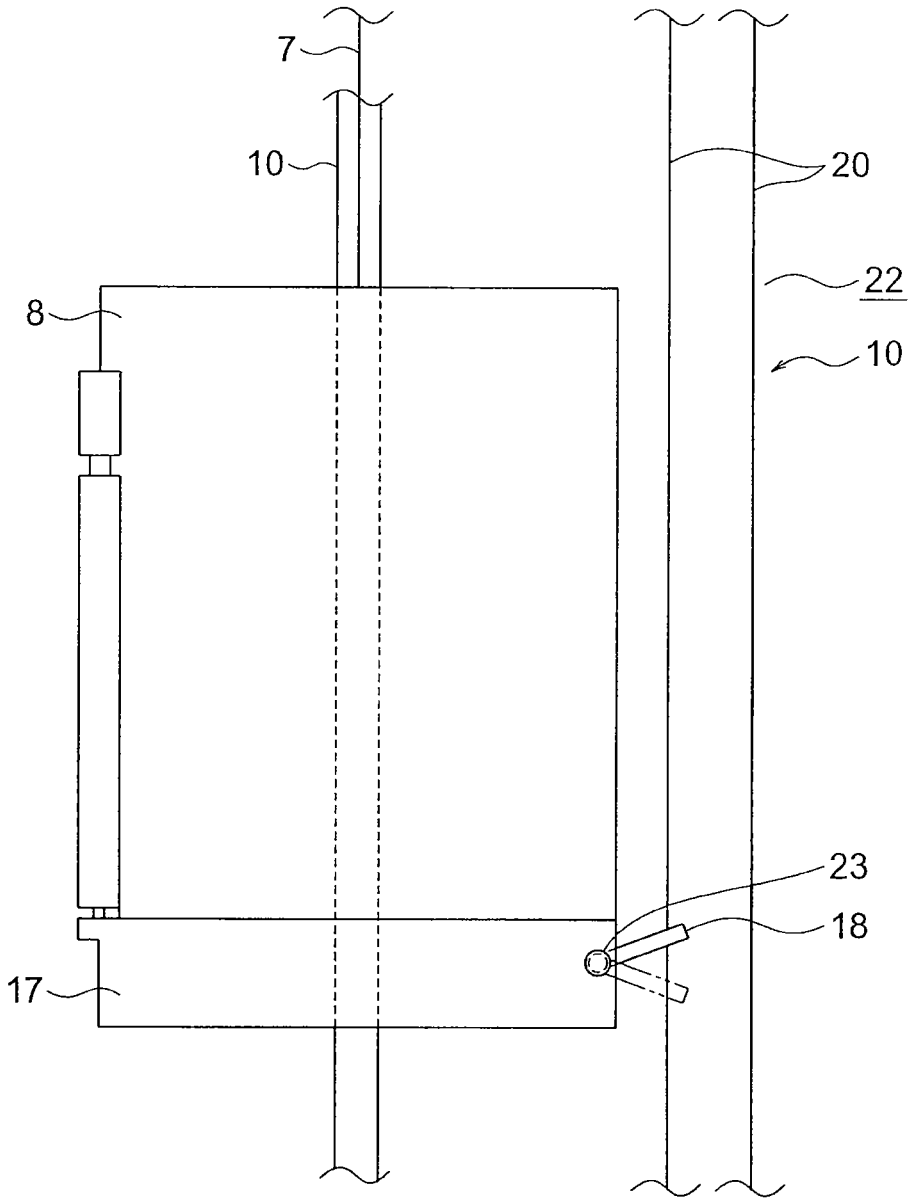
FIG. 3 is a configuration diagram that shows a state in which an actuating lever from FIG. 2 is pivoted.

The actuating lever 18 is pivoted counterclockwise (lifted) as shown in FIG. 3 in opposition to the torque of the torsion spring 23 and the weight of the actuating lever 18 and the other parts (not shown) of the safety device 17 when a force that exceeds Fs (N) in magnitude is applied upward at the position at which the speed governor rope 20 is attached, and is adjusted such that the safety device 17 is activated thereby.

The mass of the speed governor rope 20 is Mr (kg), the inertial mass of the speed governor 19 at the diameter around which the speed governor rope 20 is wound is Mg (kg), and the inertial mass of the tensioning sheave 21 at the diameter around which the speed governor rope 20 is wound is Mh (kg). That is, the inertial mass Mt (kg) of the mass 22 at the position of the actuating lever 18 is:

$$Mt=Mr+Mg+Mh.$$

Now, if the suspending means 7 breaks and the car 8 accelerates at an acceleration g ($m/s^2$), then the car 8 is subjected to an inertial force Fp (N) from the mass 22 that has a magnitude of:

$$Fp=Mt\times g \quad (1)$$

upward at the actuating lever 18. The safety device 17 is activated when this inertial force Fp (N) exceeds a force Fs (N) that is required to activate the safety device 17:

$$Fs<Mt\times g \quad (2).$$

Consequently, by adjusting the force Fs (N) that is required to activate the safety device 17 and the inertial mass Mt (kg) of the mass 22, it becomes possible to activate the safety device 17 if the suspending means 7 breaks and the car 8 falls, even if the speed governor 19 does not detect the second overspeed Vtr.

Figure 4:
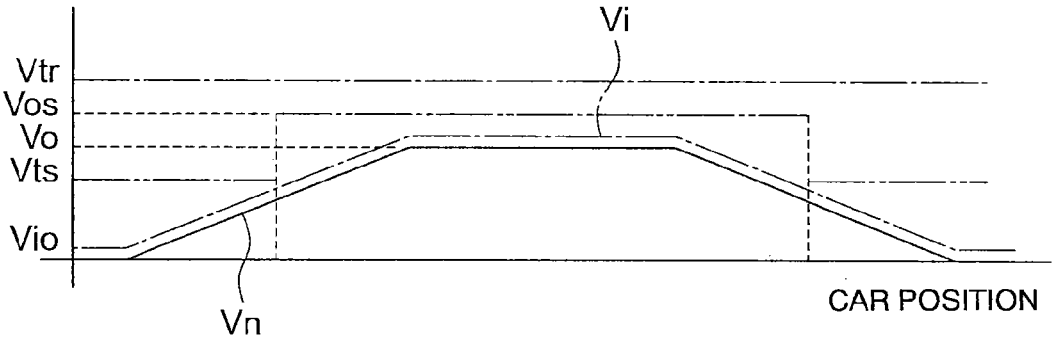
FIG. 4 is a graph that shows a relationship between car position and an abnormality detection speed in the elevator apparatus in FIG. 1.

FIG. 4 is a graph that shows a relationship between car position and an abnormality detection speed in the elevator apparatus in FIG. 1. Solid line Vn is a speed pattern of the car 8 during normal running from the upper end terminal floor to the lower end terminal floor such that maximum speed is set to the rated speed Vo.

If the car 8 free-falls due to breakage of the suspending means 7, and the acceleration of the car 8 exceeds a set value, the above inertial force Fp exceeds Fs, and the safety device 17 is activated by the abnormal acceleration detecting mechanism. When the abnormal acceleration that is detected by this abnormal acceleration detecting mechanism is substituted, the abnormality detection speed becomes overspeed Vi in FIG. 4, and the pattern is approximately parallel to the speed pattern Vn so as to be separated by a predetermined distance.

If the suspending means 7 breaks when the speed of the car 8 is zero, then the safety device 17 is activated by the inertial force of the mass 22 when the speed of the car 8 reaches Vio. The force Fs that is required to activate the safety device 17 and the inertial mass Mt of the mass 22 are adjusted such that this Vio is less than the "g×Ts" that was explained in the background art.

Consequently, the speed at which the car 8 collides with the car buffer 12 when there is an abnormality is the terminal overspeed Vts if the suspending means 7 is connected to the car 8, and a maximum of Vts+Vio if the suspending means 7 breaks, enabling speed to be reduced compared to the impact speed Vts+g×Ts onto the car buffer 12 that was explained in the background art.

Because the speed at which emergency braking is performed on the car 8 due to detection of abnormal acceleration can thereby be reduced compared to the abnormal speed that is detected by the speed governor 19, the buffering stroke of the car buffer 12 can be shortened, enabling costs of the car buffer 12 to be reduced. The dimensions in the bottom portion of the hoistway 1 for installing the car buffer 12 can also be shortened. In other words, space saving can be achieved in the hoistway 1 by a simple configuration without complicating the construction of the speed governor 19.

It is possible to set Vio to any magnitude by further adjusting the force Fs (N) that is required to activate the safety device 17 and the inertial mass Mt (kg) of the mass 22.

Figure 5:
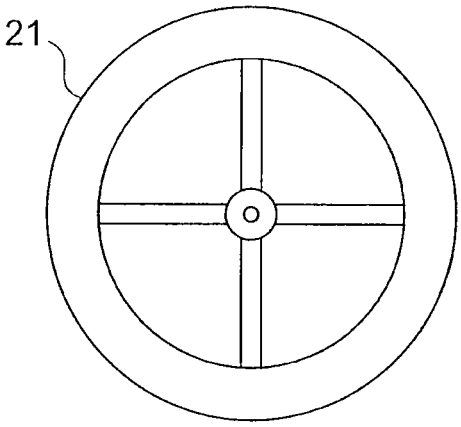
FIG. 5 is a front elevation that shows a tensioning sheave from FIG. 1.
Figure 6:
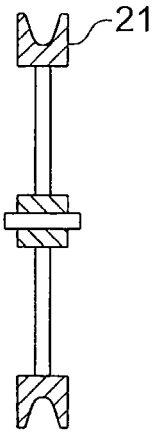
FIG. 6 is a cross section of the tensioning sheave in FIG. 5.
Figure 7:
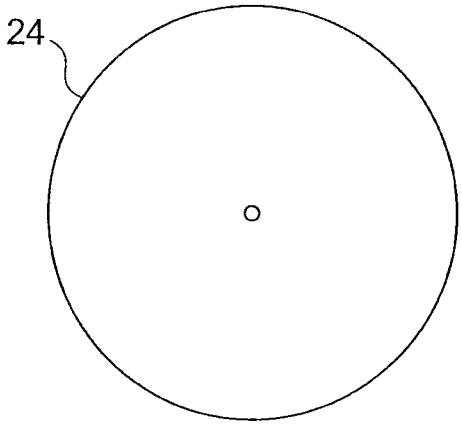
FIG. 7 is a front elevation that shows a tensioning sheave in which thickness is increased compared to the tensioning sheave in FIG. 5.
Figure 8:
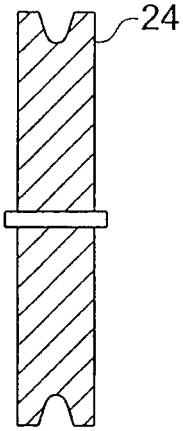
FIG. 8 is across section of the tensioning sheave in FIG. 7.

Methods for adjusting the inertial mass Mt of the mass 22 to an appropriate magnitude will now be explained. FIG. 5 is a front elevation that shows the tensioning sheave 21 from FIG. 1, and FIG. 6 is a cross section of the tensioning sheave 21 in FIG. 5. The inertial mass Mt can be adjusted by using a tensioning sheave 24 such as that shown in FIGS. 7 and 8, in which thickness is increased, for example, instead of this kind of tensioning sheave 21.

Figure 9:
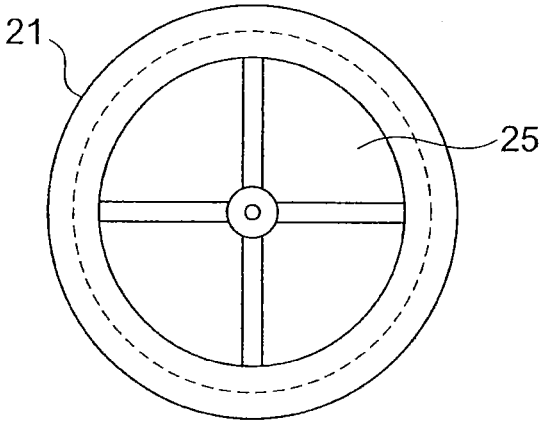
FIG. 9 is a front elevation that shows an example in which a flywheel is added to the tensioning sheave in FIG. 5.
Figure 10:
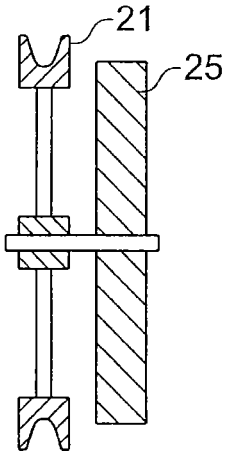
FIG. 10 is a cross section of the tensioning sheave and the flywheel in FIG. 9.

As shown in FIGS. 9 and 10, the inertial mass Mt can also be adjusted by adding a flywheel 25 that rotates coaxially with the tensioning sheave 21, for example.

In addition, in Embodiment 1, the car 8 can be stopped when the first overspeed is detected by the speed governor 19, and the safety device 17 can be activated conventionally using this speed governor 19 and speed governor rope 20 as the mass 22 during falling of the car 8. Because of that, a separate mass is not required, enabling system configuration to be simplified.

Embodiment 2

Figure 11:
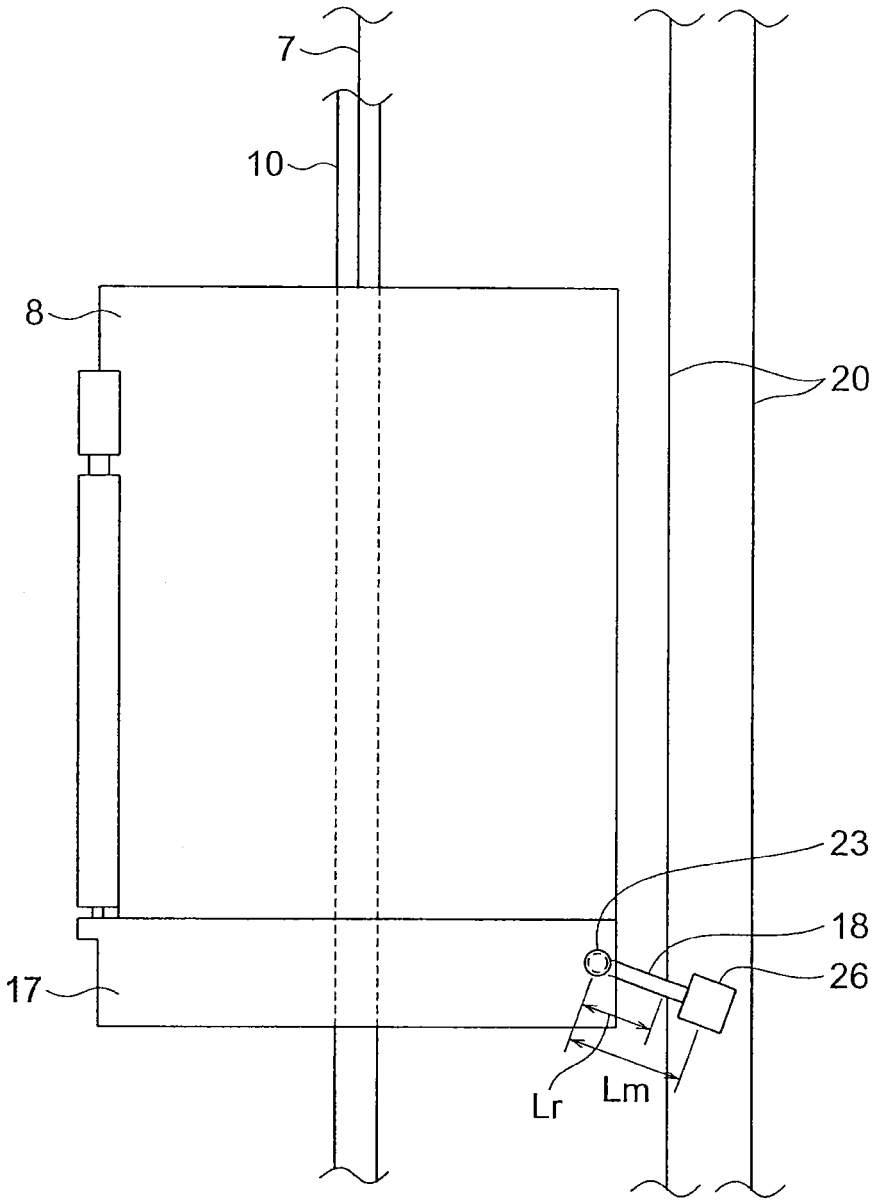
FIG. 11 is a configuration diagram that shows a car of an elevator apparatus according to Embodiment 2 of the present invention.

Next, FIG. 11 is a configuration diagram that shows a car 6 of an elevator apparatus according to Embodiment 2 of the present invention. In Embodiment 2, a weight (a mass) 26 of mass Mm (kg) is mounted onto a tip end of an actuating lever 18. An abnormal acceleration detecting mechanism according to Embodiment 2 includes a torsion spring 23 and the weight 26.

A length from a pivoting center of the actuating lever 18 to a mounted position of a speed governor rope 20 is Lr (m), and a length to a center of gravity of the weight 26 is Lm (m). Inertial mass Mt (kg) of a speed governor 19, the speed governor rope 20, and a tensioning sheave 21 are extremely small compared to the mass Mm (kg) of the weight 26. The rest of the configuration is similar or identical to that of Embodiment 1.

Now, if the suspending means 7 breaks and the car 8 accelerates at an acceleration g ($m/s^2$), then the car 8 is subjected to an inertial force Fq (N) that has a magnitude of:

$$Fq=Mm\times(Lm/Lr)\times g \quad (3)$$

upward from the weight 26 at the mounted position of the speed governor rope 20 on the actuating lever 18.

Figure 12:
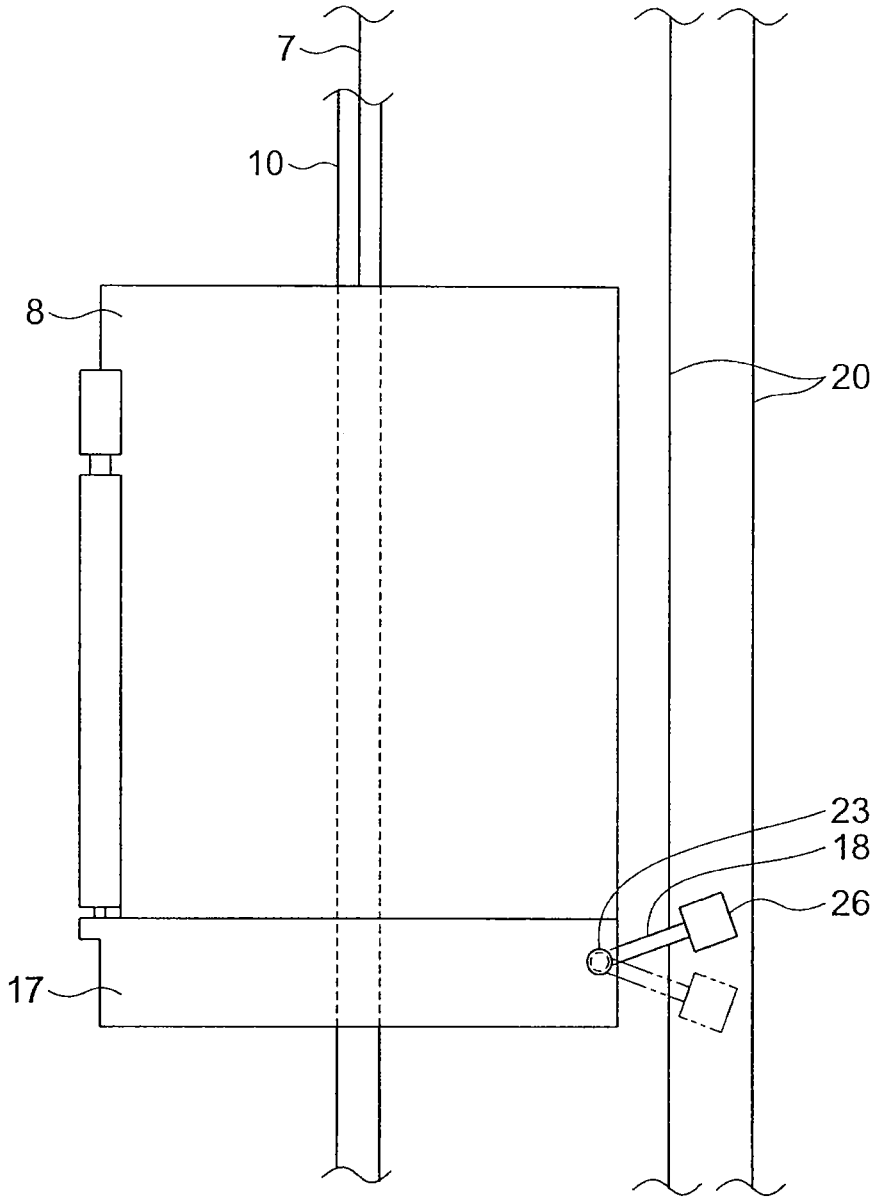
FIG. 12 is a configuration diagram that shows a state in which an actuating lever from FIG. 11 is pivoted.

If this inertial force Fq (N) exceeds the force Fs (N) that is required to activate the safety device 17, $$Fs<Mm\times(Lm/Lr)\times g \quad (4),$$

then the actuating lever 18 is pivoted counterclockwise as shown in FIG. 12, activating the safety device 17.

Thus, by adjusting the force Fs (N) that is required to activate the safety device 17, the mass Mm (kg) of the weight 26, the mounted position Lm (m) of the weight 26, etc., it becomes possible to activate the safety device 17 if the suspending means 7 breaks and the car 8 free-falls, even if the speed governor 19 does not detect the second overspeed Vtr. Consequently, space saving can be achieved in the hoistway 1 by a simple configuration without complicating the construction of the speed governor 19.

Moreover, in Embodiment 2, a case is shown in which the weight 26 is mounted to the actuating lever 18 to which the speed governor rope 20 is mounted, but operation is similar even if the speed governor rope 20 is not mounted.

In Embodiment 2, the inertial mass Mt is extremely small compared to the mass Mm, but the inertial mass Mt may also be enlarged to a certain extent, and the set value of the abnormal acceleration adjusted by combining the mass 22 according to Embodiment 1 and the weight 26 according to Embodiment 2.

In addition, the torsion spring 23 may also be omitted from the configuration according to Embodiment 2.

Embodiment 3

Figure 13:
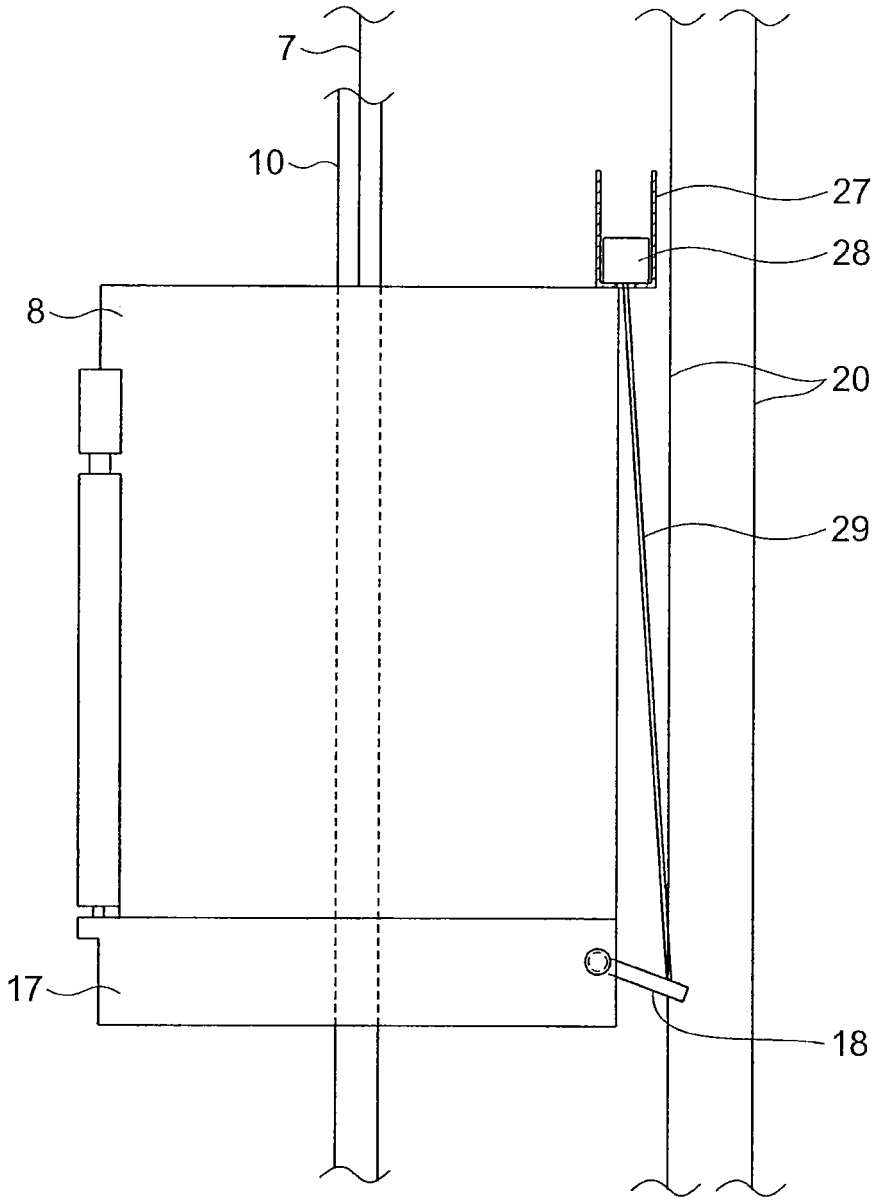
FIG. 13 is a configuration diagram that shows a car of an elevator apparatus according to Embodiment 3 of the present invention.
Figure 14:
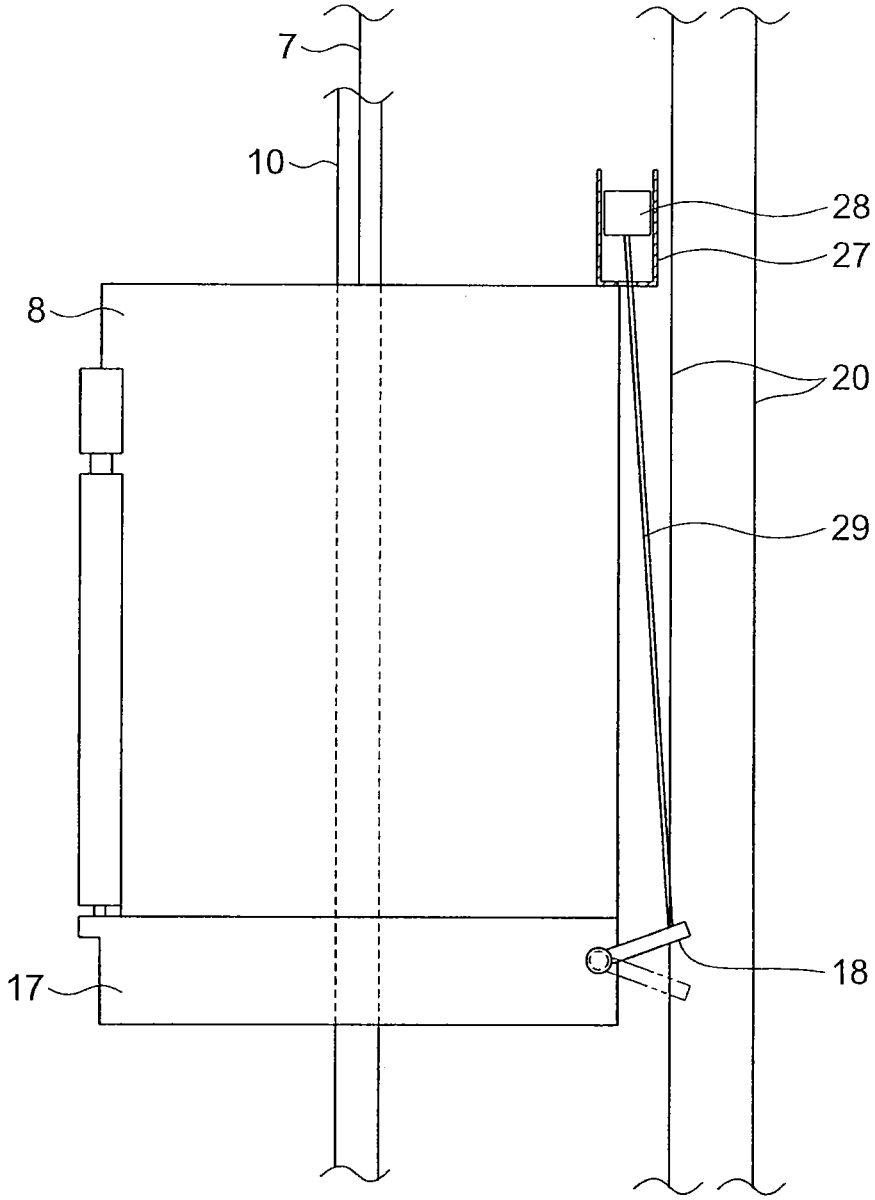
FIG. 14 is a configuration diagram that shows a state in which an actuating lever from FIG. 13 is pivoted.

Next, FIG. 13 is a configuration diagram that shows a car 8 of an elevator apparatus according to Embodiment 3 of the present invention, and FIG. 14 is a configuration diagram that shows a state in which an actuating lever 18 from FIG. 13 is pivoted. In the figures, a guiding body 27 is disposed on the car 8. A weight (a mass) 28 that is movable vertically along an inner wall surface of the guiding body 27 is inserted inside the guiding body 27.

The weight 28 is linked to the actuating lever 18 by means of a linking rod (a linking body) 29. Inertial mass Mt (kg) of a speed governor 19, a speed governor rope 20, and a tensioning sheave 21 is extremely small compared to the mass Mm (kg) of the weight 28. An abnormal acceleration detecting mechanism according to Embodiment 3 includes a torsion spring 23 and the weight 28. The rest of the configuration is similar or identical to that of Embodiment 1.

In an elevator apparatus of this kind, if the car 8 free-falls due to breakage of the suspending means 7, then the weight 28 applies an upward inertial force to the actuating lever 18 by means of the linking rod 29, as shown in FIG. 14, thereby activating the safety device 17.

Thus, by adjusting the force Fs (N) that is required to activate the safety device 17, the mass Mm (kg) of the weight 28, etc., it becomes possible to activate the safety device 17 if the suspending means 7 breaks and the car 8 falls, even if the speed governor 19 does not detect the second overspeed Vtr. Consequently, space saving can be achieved in the hoistway 1 by a simple configuration without complicating the construction of the speed governor 19.

Moreover, in Embodiment 3, a case is shown in which the weight 28 is mounted to the actuating lever 18 to which the speed governor rope 20 is mounted, but operation is similar even if the speed governor rope 20 is not mounted.

In Embodiment 3, the inertial mass Mt is extremely small compared to the mass Mm, but the inertial mass Mt may also be enlarged to a certain extent, and the set value of the abnormal acceleration adjusted by combining the mass 22 according to Embodiment 1 and the weight 28 according to Embodiment 3.

In addition, it is also possible to use the weight 28 according to Embodiment 3 and the weight 26 according to Embodiment 2 in combination.

Furthermore, because the force Fs that is required to activate the safety device 17 is adjusted, the torsion spring 23 can also be disposed or omitted in a similar or identical manner to that of Embodiment 2.

Embodiment 4

Figure 15:
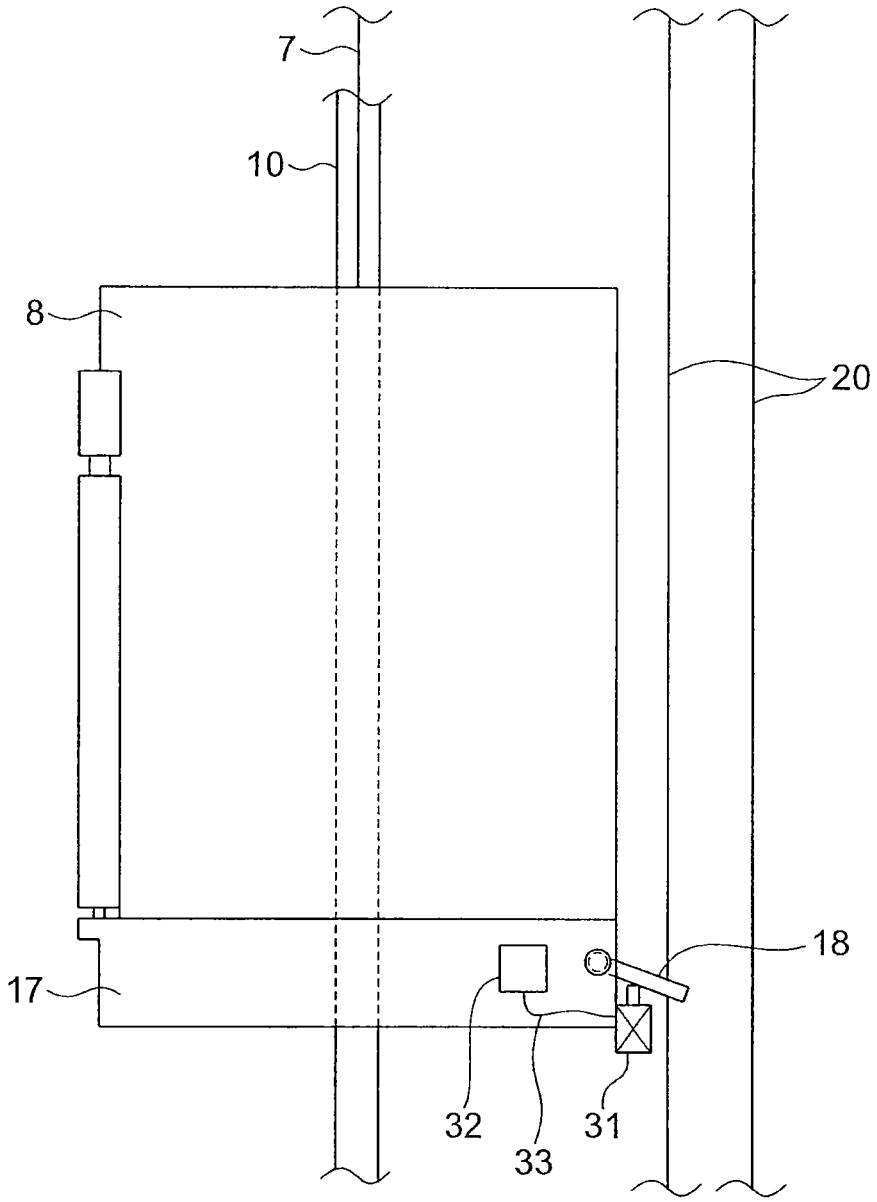
FIG. 15 is a configuration diagram that shows a car of an elevator apparatus according to Embodiment 4 of the present invention.
Figure 16:
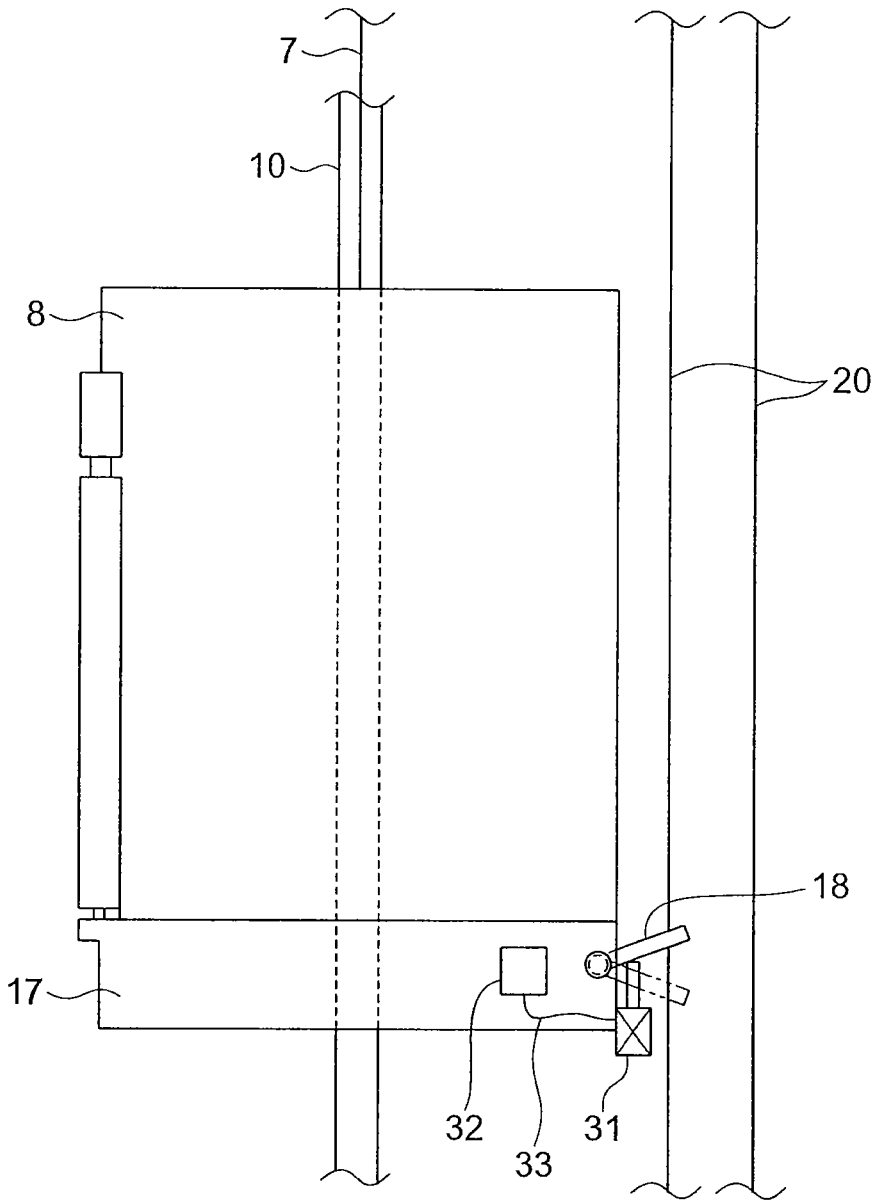
FIG. 16 is a configuration diagram that shows a state in which an actuating lever from FIG. 15 is pivoted.

Next, FIG. 15 is a configuration diagram that shows a car 8 of an elevator apparatus according to Embodiment 4 of the present invention, and FIG. 16 is a configuration diagram that shows a state in which an actuating lever 18 from FIG. 15 is pivoted. In the figures, mounted onto a frame body of a safety device 17 are: an actuator 31 that operates the actuating lever 18; and an acceleration detecting portion 32 that controls the actuator 31 in response to acceleration of the car 8. The acceleration detecting portion 32 is connected to the actuator 31 by means of a signal wire 33.

An acceleration sensor is disposed on the acceleration detecting portion 32, and an operating command signal is output to the actuator 31 when acceleration of the car 8 exceeds a preset set value. The actuator 31 pivots the actuating lever 18 to activate the safety device 17 when the operating command signal is received. An abnormal acceleration detecting mechanism according to Embodiment 4 includes the actuator 31, the acceleration detecting portion 32, and the signal wire 33. Overall configuration of the elevator apparatus is similar or identical to that of Embodiment 1.

The set value of the acceleration in the acceleration detecting portion 32 is less than or equal to acceleration g (9.8 $m/s^2$) of the car 8 during falling due to breakage of the suspending means 7. Thus, if the suspending means 7 breaks and the car 8 accelerates at gravitational acceleration, the safety apparatus 17 can be activated by moving the actuator 31 as shown in FIG. 16.

The set value of the acceleration in the acceleration detecting portion 32 is set to a value that is higher than acceleration during normal operation such that rapid acceleration of the car 8 due to an abnormality in the controlling apparatus 5 can also be detected, and is also set to a value that is higher than deceleration rate when performing urgent stopping (also known as an "E-Stop") due to a power outage during ascent of the car 8. Moreover, such abnormality detecting acceleration control settings can also be applied to Embodiments 1 through 3.

Using an elevator apparatus of this kind, it also becomes possible to activate the safety device 17 if the suspending means 7 breaks and the car 8 free-falls, even if the speed governor 19 does not detect the second overspeed Vtr. Consequently, space saving can be achieved in the hoistway 1 by a simple configuration without complicating the construction of the speed governor 19.

Moreover, in Embodiment 4, the acceleration detecting portion 32 is mounted onto the frame body of the safety device 17, but may also be mounted onto the car 8 or other equipment, etc., that is fixed to the car 8.

In Embodiments 1 and 2, a torsion spring 23 is used in order to adjust the force Fs that is required to activate the safety device 17, but a spring, etc., does not necessarily have to be added, provided that an adequate force Fs can be achieved and, if added, is not limited to a torsion spring.

In addition, in Embodiments 1 through 4, the safety device 17 is a braking apparatus that is operated by an abnormal acceleration detecting mechanism, but is not limited thereto.

Furthermore, in FIG. 1, a one-to-one (1:1) roping elevator apparatus is shown, but the roping method is not limited thereto, and the present invention can also be applied to two-to-one (2:1) roping elevator apparatuses, for example.

The present invention can also be applied to machine-roomless elevators that do not have a machine room 2, or to various other types of elevator apparatus, etc.

The invention claimed is:

1. An elevator apparatus comprising:

a car;

a suspending means that suspends the car;

a driving apparatus that raises and lowers the car by means of the suspending means;

a braking apparatus that brakes the car; and an abnormal acceleration detecting mechanism that operates the braking apparatus to stop the car if acceleration that exceeds a preset set value arises in the car, wherein the braking apparatus is a safety device that is installed on the car, wherein an actuating lever that vales the safety device is disposed on the safety device, the actuating lever including a weight mounted onto a tip end of the actuating lever, wherein the abnormal acceleration detecting mechanism includes a mass that operates in connection with movement of the car, and operates the safety device using a force that is generated by the mass if the acceleration that exceeds the set value arises in the car, wherein the mass includes a rope that is arranged in a loop inside a hoistway, and a sheave around which the rope is wound, wherein the abnormal acceleration detecting mechanism further includes a spring that applies torque to the actuating lever in a direction that is opposite to the direction that operates the safe device, and wherein the safety device is activated when the car falls due to breakage of the suspending means, and an inertial force of the mass exceeds a force that is required to activate the safety device.

2. The elevator apparatus according to claim 1, further comprising a speed governor that detects an overspeed of the car, wherein the set value is set such that a speed of the car at which the braking apparatus is operated by the abnormal acceleration detecting mechanism is lower than an overspeed that is set in the speed governor.

3. The elevator apparatus according to claim 2, further comprising a buffer that buffers collision of the car onto a hoistway bottom portion.

4. The elevator apparatus according to claim 1, further comprising a speed governor that detects an overspeed of the car, the sheave around which the rope is wound being a speed governor sheave that is disposed on the speed governor, and the rope being a speed governor rope.

5. The elevator apparatus according to claim 1, wherein the abnormal acceleration detecting mechanism comprises:

an acceleration detecting portion that generates an operating command signal if acceleration that exceeds the set value arises in the car; and an actuator that operates the braking apparatus in response to the operating command signal.

6. The elevator apparatus according to claim 1, wherein the actuating lever is connected to the rope at a first distance from a pivoting center of the actuating lever, and the weight is mounted onto the tip end of the actuating lever at a second distance from the pivoting center, wherein the second distance is greater than the first distance.

* * * * *